US008306233B2

(12) United States Patent
Sinton et al.

(10) Patent No.: US 8,306,233 B2
(45) Date of Patent: Nov. 6, 2012

(54) TRANSMISSION OF AUDIO SIGNALS

(75) Inventors: Lee Corey Sinton, Berkshire (GB); Neil Briffett, Surrey (GB)

(73) Assignee: Nokia Corporation, Espoo (FI)

( * ) Notice: Subject to any disclaimer, the term of this patent is extended or adjusted under 35 U.S.C. 154(b) by 1145 days.

(21) Appl. No.: 12/140,710

(22) Filed: Jun. 17, 2008

(65) Prior Publication Data

US 2009/0310790 A1 Dec. 17, 2009

(51) Int. Cl.
*H04H 20/47* (2008.01)

(52) U.S. Cl. ..... 381/2; 381/17; 381/23

(58) Field of Classification Search ..... 381/2, 11, 381/17, 18, 19, 20, 21, 22, 23, 80, 81, 123, 381/1; 700/94; 704/500–504
See application file for complete search history.

(56) References Cited

U.S. PATENT DOCUMENTS

| | | | | |
|---|---|---|---|---|
| 7,602,899 | B1 * | 10/2009 | Thenthiruperai | 379/265.02 |
| 7,627,289 | B2 * | 12/2009 | Huddart | 455/41.2 |
| 8,069,034 | B2 * | 11/2011 | Makinen et al. | 704/201 |
| 2003/0008616 | A1 | 1/2003 | Anderson | |
| 2005/0136848 | A1 * | 6/2005 | Murray | 455/79 |
| 2005/0288067 | A1 * | 12/2005 | Wainwright | 455/567 |
| 2006/0088175 | A1 * | 4/2006 | Eid et al. | 381/104 |
| 2006/0182289 | A1 * | 8/2006 | Chu | 381/86 |
| 2007/0116297 | A1 * | 5/2007 | Mishra | 381/77 |
| 2007/0168183 | A1 * | 7/2007 | Van De Kerkhof | 704/200.1 |
| 2008/0084981 | A1 * | 4/2008 | Lee et al. | 379/201.01 |
| 2008/0183755 | A1 * | 7/2008 | Zak | 707/104.1 |
| 2008/0205664 | A1 * | 8/2008 | Kim et al. | 381/77 |

FOREIGN PATENT DOCUMENTS

EP 0483956 A2 6/1992

* cited by examiner

*Primary Examiner* — Samuel Gebremariam
*Assistant Examiner* — Yosef Gebreyesus
(74) *Attorney, Agent, or Firm* — Banner & Witcoff, Ltd.

(57) ABSTRACT

In accordance with an example embodiment of the present invention, an apparatus is presented that comprises a multichannel audio transmitter which has a first mode for transmitting a multichannel audio signal and a second mode for transmitting at least a first and a second audio signal, each having fewer channels than the multichannel audio transmitter. A controller is configured to switch the multichannel audio transmitter from the first mode to the second mode when the first audio signal becomes available.

35 Claims, 5 Drawing Sheets

TRANSMISSION OF AUDIO SIGNALS

TECHNICAL FIELD

The present application relates generally to the transmission of one or more audio signals.

BACKGROUND

Electronic devices which are capable of music playback have become very popular recently. Such players, especially portable or mobile players, are mainly intended for being used in conjunction with head- or earphones. For a typical mobile use of such devices this is a preferred manner of listening. However, a user may have a large amount or even all of his own music stored on such a device and may also want to use the player as a source of music in other environments. The user may want to play back music with normal loudspeakers.

Additionally, a user may want to use such a player as a source of music or other stored audio data in a vehicle, for example as a replacement for a CD-changer. However, car audio systems usually do not comprise an interface to connect to a mobile player. As one of the main advantages of a mobile music player is the possibility to carry it easily while on the move, a user may want to connect such an audio player to many different playback devices, preferably without the use of cables.

As many audio playback devices like stereo systems and car audio systems comprise an FM (frequency modulation) tuner or receiver, a known implementation of a corresponding wireless transmission is to "mimic" the audio player as a conventional FM radio station and to transmit the audio data encoded as a standard FM radio broadcast transmission.

In the United States of America the FCC (Federal Communications Commission) allows the usage of unlicensed (for example personal/private) FM-radio transmitters according to FCC rule 15 (see section 15.239). Similar legislation applies in many other countries. An unlicensed FM radio transmitter can thus be used for conveniently transmitting sound or music wirelessly from any device, for example from a CD-player or an MP3-player, to an FM radio operating for example in the 88-108 MHz band. In some countries the FM radio band may use a different frequency range. This allows listening to music from such a device for example through a car FM radio. Due to the restricted transmission power with a field strength of 250 μV/m in a distance of 3 meters as in U.S. FCC rule 15, the transmission range of such private transmitters is small. Interference is therefore expected to be low. In addition, interference with licensed FM transmitters, for example a radio station, is usually not allowed.

Thus, unlicensed FM transmitters can be used for example in the car or home environment in order to replay the stored audio content using a car audio or home stereo system.

In addition to music playback devices like MP3-players or CD-players, there are mobile devices that contain an audio player application in addition to a number of further applications like a mobile phone, a camera etc. For example, a number of currently available mobile phone models contain an audio player (for example an MP3 player) and an FM transmitter for transmission of an audio signal to an FM receiver.

SUMMARY

According to a first aspect, an apparatus is provided comprising a multichannel audio transmitter, the transmitter having a first mode for transmitting a multichannel audio signal and a second mode for transmitting at least a first and a second audio signal.

In accordance with a further aspect, a method is provided comprising transmitting a multichannel audio signal with a multichannel audio transmitter. When a first audio signal is made available or when it is detected that a first audio signal is available, the first audio signal and a second audio signal are transmitted instead of the multichannel audio signal.

Each of the first and second audio signals has fewer channels than the multichannel audio transmitter. The apparatus comprises a controller that is configured to switch the multichannel audio transmitter from the first mode to the second mode when the first audio signal becomes available.

In accordance with an example embodiment, the controller is notified or detects when a first audio signal is available and switches the transmitter from the first mode to the second mode upon availability of the first audio signal. The controller may be implemented as a control unit. The controller or control unit may be implemented in hardware or as software instructions on a microcontroller, microprocessor or digital signal processor (DSP).

In accordance with a further example embodiment, the first audio signal is transmitted on a first subset of channels from the multichannel audio transmitter and the second audio signal is transmitted on a second subset of channels from the multichannel audio transmitter in the second mode.

In accordance with a further example embodiment, the multichannel audio transmitter is capable of transmitting a Dolby™ surround signal with for example 5 or 7 audio channels and the multichannel audio signal is a Dolby™ surround signal with for example 5 or 7 audio channels.

In accordance with a further example embodiment, the multichannel audio transmitter is a stereo audio transmitter and the multichannel audio signal is a stereo audio signal. The first audio signal is a first mono audio signal, and the second audio signal is a second mono audio signal. The second mono audio signal may correspond to the stereo audio signal. For example, the second mono audio signal may be either a right or a left channel of the stereo audio signal. Or the second mono audio signal may be mixed from a right and a left channel of the stereo audio signal.

In a further embodiment, the second audio signal is transmitted at a lower volume than the first audio signal. Further, the second audio signal may be transmitted at a lower volume than a channel of the multichannel audio signal.

The stereo audio transmitter may be an FM transmitter or a low power RF transmitter capable of stereo transmission, like a Bluetooth™ transmitter using A2DP or another profile capable of sending a first audio signal to one or more receivers.

In accordance with another example embodiment, a stereo audio signal is generated from an audio player application running on the apparatus. In a further embodiment, the apparatus comprises an audio player which generates a stereo audio signal. The stereo audio signal may be stored as an audio file in a memory of the apparatus, for example in a format suitable for memory efficient storage or for transmission. In a further embodiment, the stereo audio signal is received, for example by streaming or by file transfer, over a wired or wireless interface. The received stereo audio signal may be stored or buffered in a memory before transmission.

In a further embodiment, the first audio signal is an incoming call alert tone, an incoming voice stream from a telephone call, a text to voice notification of an incoming message, or the like. The first audio signal may be a first mono audio signal.

In accordance with a further example embodiment of the present invention, the second audio signal is a mono audio signal which is generated from the multichannel audio signal from the audio player or audio player application. Thus, the multichannel audio transmitter will replace one channel (for example either the right or the left main audio channel) of the multichannel audio signal by the first mono audio signal and a second channel of the multichannel audio signal by the second mono audio signal. The second mono audio signal may be either one channel of the multichannel audio signal, or it may be mixed from the channels of the multichannel audio signal. If the multichannel audio signal is a stereo audio signal, the second mono audio signal may be mixed from the left and right channel of the stereo audio signal. In a further embodiment, the second mono audio signal may be a different signal, like a repeated jingle, a voice tag or a music tag, indicating a pause.

In a further aspect, there is provided a method comprising transmitting a multichannel audio signal, for example a stereo audio signal, detecting that a first mono audio signal is available, and—upon detection of the first mono audio signal—transmitting the first mono audio signal and a second mono audio signal instead of the stereo audio signal. This means, that the first and second mono audio signals take the place in the transmission of the stereo audio channels. In this way, the receiving device will reproduce the first mono audio signal on the connected left loudspeaker, and the second mono audio signal on the connected right loudspeaker, or vice versa.

In a yet further aspect, there is provided a computer program product and a computer readable medium storing one or more computer readable instructions that, when executed cause a processor to perform transmitting in a multichannel audio transmitter a multichannel audio signal, detecting that a first audio signal is available, wherein the first audio signal has fewer channels than the multichannel audio transmitter, upon detection of the first audio signal transmitting the first audio signal and a second audio instead of the multichannel audio signal, wherein the second audio signal has fewer channels than the multichannel audio transmitter.

In a further aspect, an apparatus is provided comprising a means for transmitting a multichannel audio signal. The apparatus further comprises a switching means having a first mode to connect a multichannel audio signal to a multichannel input of said means for transmitting and a second mode to connect a first and a second audio signal to the multichannel input of said means for transmitting, wherein the first audio signal and the second audio signal each have fewer channels than the means for transmitting a multichannel audio signal, and wherein the switching means is capable of switching from the first mode to the second mode when the first audio signal is available.

BRIEF DESCRIPTION OF THE DRAWINGS

For a more complete understanding of example embodiments of the present invention, reference is now made to the following descriptions taken in connection with the accompanying drawings in which.

DETAILED DESCRIPTION OF THE DRAWINGS

An example embodiment of the present invention and its potential advantages are best understood by referring to FIGS. 1 through 5 of the drawings.

The following description describes example embodiments of the invention using FM transmission. However, it is to be noted that the invention is not limited to FM radio transmission technology, but may be used in connection with other analog or digital transmission technologies like Bluetooth, W-LAN, Wi-Fi, WIMAX and so on.

In an example embodiment, the term "audio player" is meant to comprise any audio reproduction device or application that can replay stored or received audio signals that may either be available in a digital or in an analogue mode. For example, the audio signal may be stored in a memory in a digitally coded form like MP3, Ogg Vorbis, AAC (advanced audio coding) or PCM (pulse code modulation), or it may be received through a wireless or wired interface, such as a mobile or fixed line internet connection in a digital form.

In an example embodiment, a mobile device comprising an audio player and an FM transmitter allows one or more listeners to listen to a playback of a first audio signal. During listening a different source of audio may become active and produce a second audio signal, for example a phone alert tone. The second audio signal may replace the first audio signal that is transmitted up to that point, or the second audio signal may be mixed into the first audio signal. However, the phone alert might be directed to only one of the listeners, and other listeners might not want to be involved in the alerted phone call or might want to continue listening to the first audio signal.

A similar scenario may occur if a low power RF (radio frequency) like a Bluetooth™ transmission is used instead of the FM transmission. For example, stereo audio may be transmitted from a mobile device through a Bluetooth™ connection using A2DP (advanced audio distribution profile) that is defined in the Bluetooth™ specification.

For example, a mobile device may contain an audio player application and a Bluetooth™ transceiver capable of A2DP transmissions. If music playback is started, a Bluetooth™ connection may be set up to a further device capable of A2DP Bluetooth™ reception. The further device may be a car audio system, a home stereo system, or a computer that is connected to one or more loudspeakers. Thus, the music from the audio player application is replayed through the connected further device.

Again, if in the mobile device a source of a second audio signal becomes active, the second audio signal can either replace the first audio signal or it can be mixed into the first audio signal.

Figure 1:
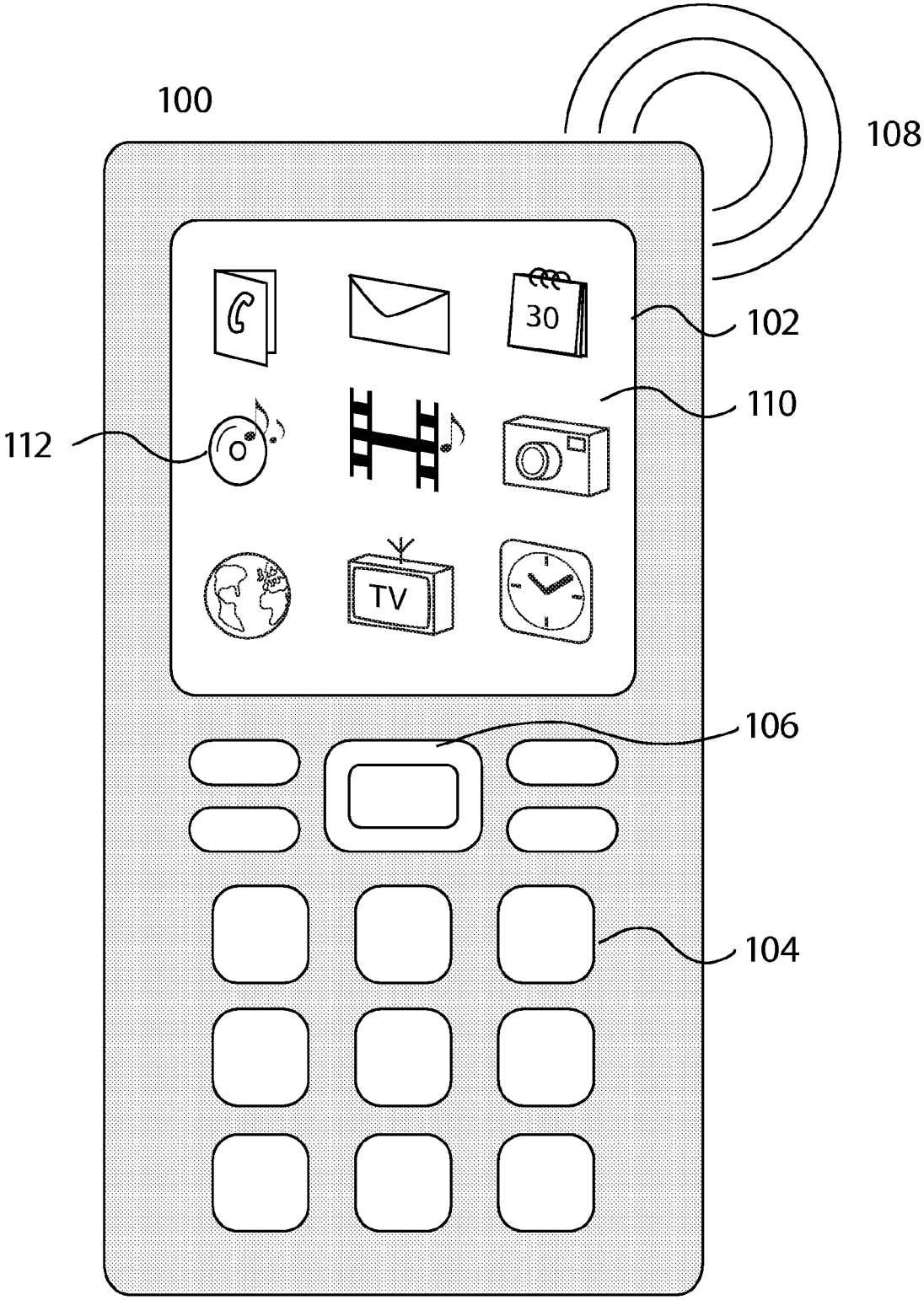
FIG. 1 shows an apparatus according to an embodiment of the invention.

FIG. 1 shows an apparatus 100 according to an embodiment of the invention, for example a mobile device, comprising a number of applications 110 which are shown in the display 102. In the example embodiment, the applications comprise a telephone application which may comprise a phone directory. The applications may further comprise a messaging application, a calendar, a gallery, a camera, an internet browser, a mobile TV application and a clock. Further, the example apparatus 100 comprises an audio player application 112 and an FM transmitter. The FM transmission signal is illustrated by waves 108. The audio player application 112 may be configured to use FM transmission for playback of an audio signal at another device, for example when FM transmission is selected by a user. The audio player application 112 and FM transmission may be activated and controlled by keyboard 104. Keyboard 104 may include a navigator key 106.

Figure 2:
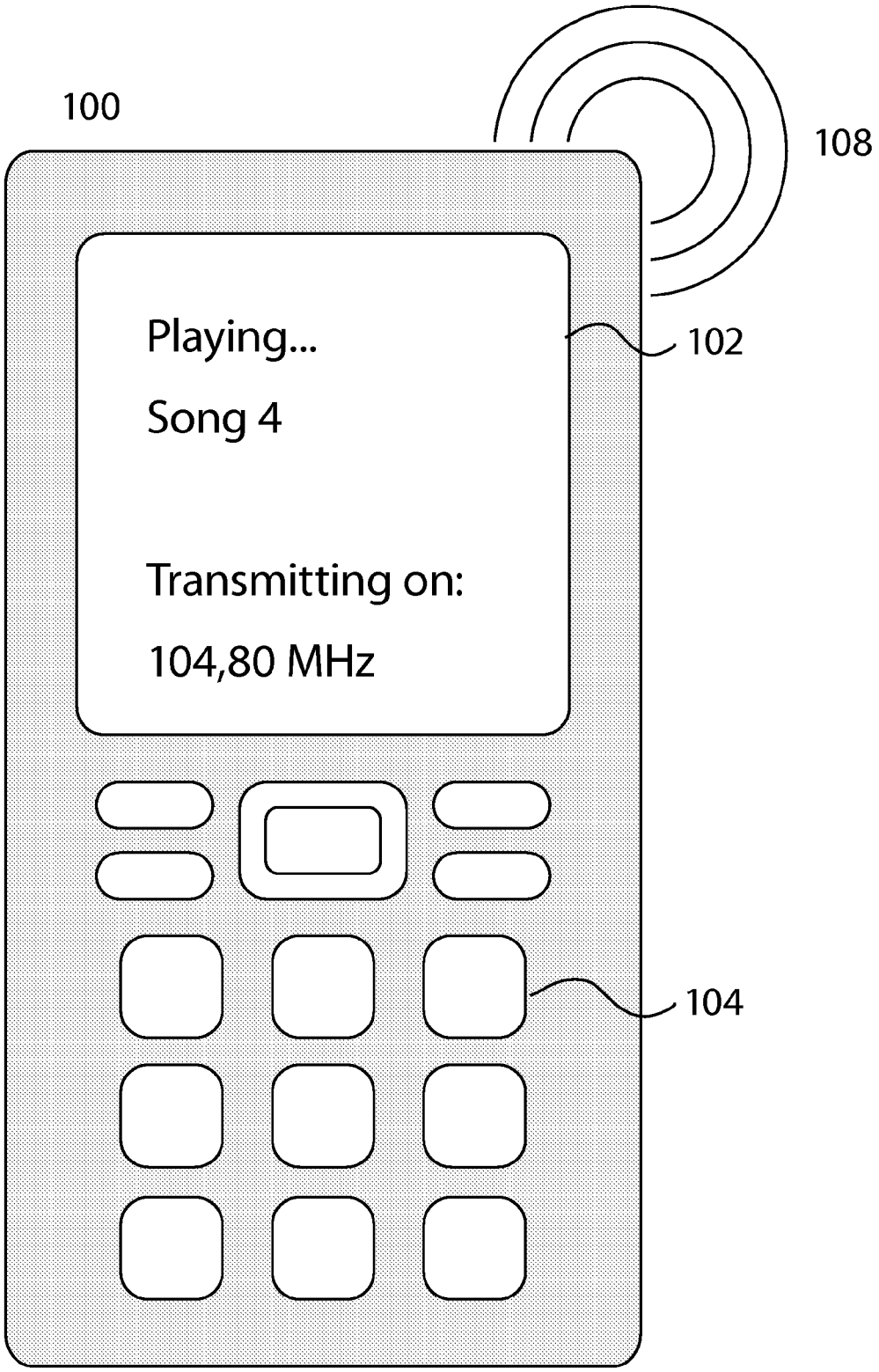
FIG. 2 shows the apparatus of FIG. 1 when an audio player application is active.

FIG. 2 shows the apparatus 100 of FIG. 1 when the audio player application 112 is active. Display 102 may show which audio title is currently played, for example "Song 4" from the user's collection of audio titles stored in the device. The display 102 may also indicate the FM radio transmission frequency that is currently being used for transmission: "104.80 MHz". Keyboard 104 may be used to start and stop the player, switch FM transmission on or off, or to select a different frequency. An FM transmission signal 108 is sent out for reception by an FM radio receiver.

In the embodiments depicted in FIGS. 1 and 2, the FM transmitter is capable of transmitting a stereo signal. In particular, it may be designed to transmit the left and right channels of a stereo audio signal on one carrier frequency. In the present embodiment, the left channel L and right channel R are encoded into sum (L+R) and difference (L−R) signals in order to provide compatibility with mono receivers. The (L+R) sum signal is transmitted in a band of 30 Hz to 15 kHz, the (L−R) difference signal is modulated onto a 38 kHz double-sideband suppressed carrier signal occupying the range of 23 to 53 kHz. A 19 kHz pilot tone is added to the resulting signal to enable a stereo receiver to retrieve the 38 kHz carrier signal. A stereo receiver will thus be able to recover the (L+R) sum and (L−R) difference signals. By adding and subtracting the sum and difference signals to each other, the original left and right signals can be retrieved. However, a mono receiver will decode only the (L+R) sum signal and suppress all frequencies above 15 kHz, so that both channels can be replayed in one single loudspeaker without disturbance by the modulated difference signal or the pilot tone.

An FM transmitter capable of transmitting a stereo signal may also be configured in such a way that a first mono audio signal is transmitted as the left channel of the transmitted signal and a second mono audio signal is transmitted as the right channel of the transmitted signal, or vice versa.

Figure 3:
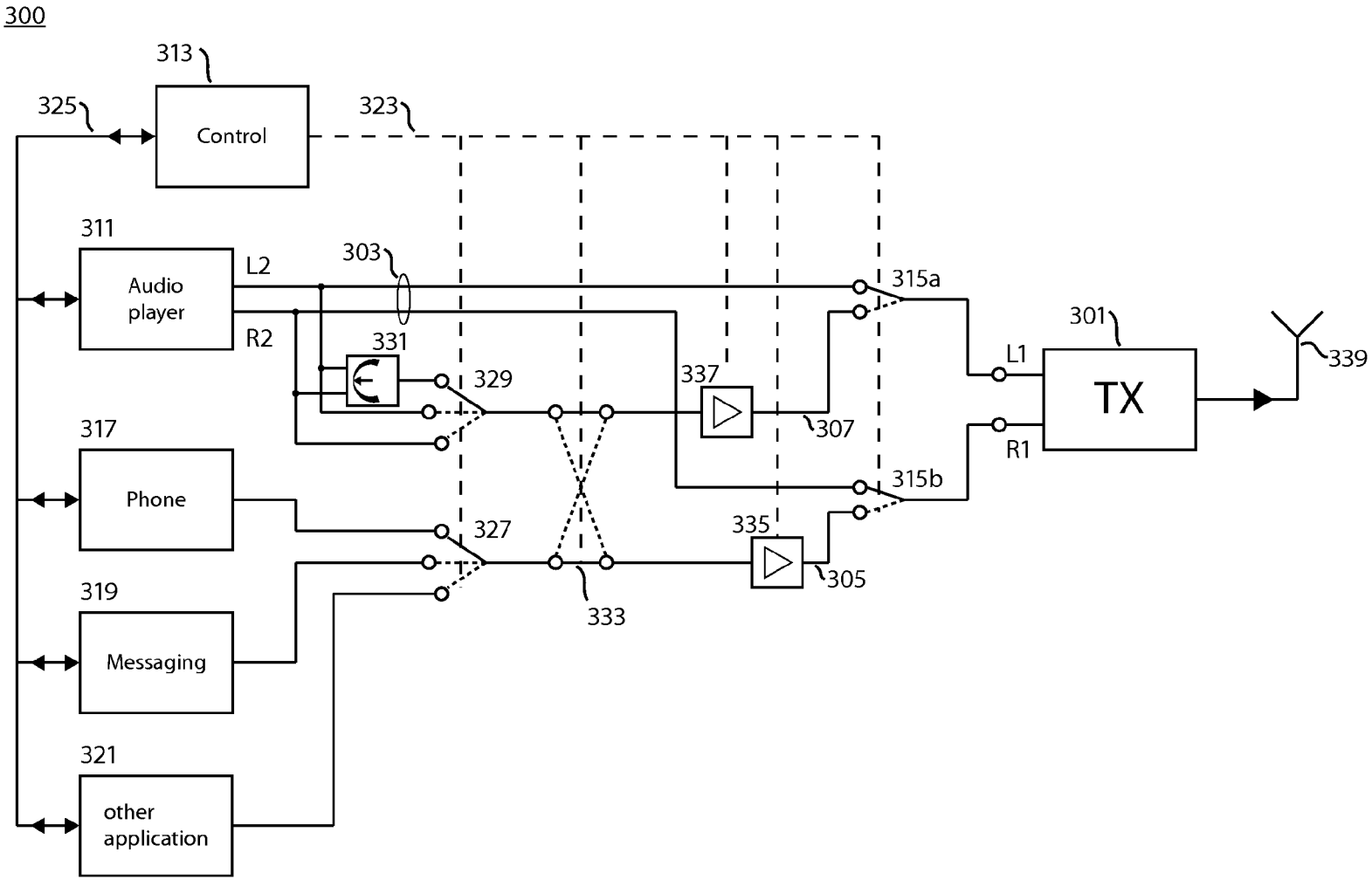
FIG. 3 shows a block diagram of blocks of an apparatus according to an embodiment of the invention.

FIG. 3 shows a schematic overview 300 of building blocks and the flow of audio signals within an apparatus 100. Inputs L1 and R1 of an FM transmitter 301 are connected through switches 315*a* and 315*b* either to a stereo audio signal 303 or to a first mono audio signal line 305 and a second mono audio signal line 307. The stereo audio signal is generated by an audio player or audio player application 311. The first mono audio signal is generated by a mobile phone transceiver or a phone application 317, a messaging application 319 or another hardware or software block or another application 321, for example a calendar application or a navigation application, that may generate an audio output. Audio routing is controlled by a controller or a control block 313 through control bus 323.

When the audio player is active and no further audio signal is available, control block 313 sets switches 315*a* and 315*b* in a first position in which they connect the stereo audio signal 303 to FM transmitter 301. In this situation, neither the phone application 317 nor the messaging application 319 nor the other application 321 generate an audio signal that would be intended for routing to the FM transmitter 301.

When the phone application 317 generates an audio output, for example an alert tone or a voice communication, the phone application 317 requests an audio connection from the control block 313 through communication bus 325. The request is interpreted by the control block 313 as a request to connect the audio output of the phone application 317 with an audio input of the FM transmitter 301. The control block 313 controls switches 315*a* and 315*b* through control bus 323 and switches them in the second position in which inputs L1 and R1 of the FM transmitter 301 are connected to the first and second mono audio signal lines 305, 307. Control block 313 further controls switch 327 to connect the first mono audio signal line 305 with the source of the audio signal, for example the phone application 317.

When the messaging application 319 generates an audio output, for example an alert tone or a text-to-speech converted text message, the messaging application 319 requests an audio connection from the control block 313 through communication bus 325. The request is interpreted by the control block 313 as a request to connect the audio output of the messaging application 319 with an audio input of the FM transmitter 301. The control block controls switches 315*a* and 315*b* through control bus 323 and switches them in the second position in which inputs L1 and R1 of the FM transmitter 301 are connected to the first and second mono audio signal lines 305, 307. Control block 313 further controls switch 327 to connect the first mono audio signal line 305 with the source of the audio signal, i.e. the messaging application 319.

When the other application 321 generates an audio output, for example an alert tone, the other application 321 requests an audio connection from the control block 313 through communication bus 325. The request is interpreted by the control block 313 as a request to connect the audio output of the other application 321 with an audio input of the FM transmitter 301. The control block 313 controls switches 315*a* and 315*b* through control bus 323 and switches them in the second position in which inputs L1 and R1 of the FM transmitter 301 are connected to the first and second mono audio signal lines 305, 307. Control block 313 further controls switch 327 to connect the first mono audio signal line 305 with the source of the audio signal, i.e. the other application 321.

Control block 313 also controls switch 329 which defines a source for the second mono audio signal that is different from the first mono audio signal. The source for the second mono audio signal may be either the left or the right channel of the stereo audio signal from the audio player 311, or a combined signal in which the left and right channel from the audio player are mixed by mixer 331. In a particular embodiment, left and right channel are added, and the added signal is divided to half the amplitude in order to make up for the increase in volume by the addition. However, more sophisticated mixing techniques may be implemented in mixer 331.

In an alternative embodiment, control block 313 instructs audio player 311 to pause playback of the currently played audio signal and generate or replay a pause jingle or tone which is fed as a second mono audio signal on the second mono audio signal line 307 to FM transmitter 301 as long as there is a first mono audio signal on the first mono audio signal line 305. Timing of the audio player 311 is controlled by control block 313. The pause jingle or tone may be played or repeated as long as the first mono audio signal line 305 is generated or played.

In an embodiment, control block 313 controls amplifiers/attenuators 335 and 337 which control the amplitude of the first and the second mono audio signal, respectively. For example, the first mono audio signal on the first mono audio signal line 305 may be amplified by amplifier/attenuator 335 (gain>1) in order to make the sound of this signal more alerting or any voice in the audio signal more understandable. In addition, the second mono audio signal on the second mono audio signal line 307 may be attenuated by amplifier/attenuator 337 (gain<1) in order to make the second mono audio signal less disturbing while the first mono audio signal is played. In embodiments of the invention, the factors may be predetermined by factory settings or alternatively by a user. The gain factors may be stored as settings in a memory (not shown) of the apparatus 100.

In this way, the volume of the second mono audio signal can be controlled compared to the volume of the first mono audio signal or compared to one of the channel of the stereo audio signals it replaces.

For example, the second mono audio signal may be transmitted at a lower volume than the first mono audio signal. Further, the second mono audio signal may be transmitted at a lower volume than the corresponding channel of the stereo audio signal it replaces.

In an embodiment, amplifiers and/or attenuators 335 and 337 are absent from the signal paths. Thus, in such an embodiment volume control of the separate paths is not provided. Alternatively, the volume of the respective path may be controlled somewhere else, for example in the generating blocks like the audio player 311, the phone application 317, the messaging application 319 or the other application 321.

In a further embodiment, the connection of the first and second mono audio lines 305 and 307 to the left and right input L1, R1 of the FM transmitter can be switched by switch 333. In this way, audio from the phone application 317, messaging application 319 or other application 321 may be transmitted by the FM transmitter either as the left or right channel of the transmission signal. For example, when an embodiment of the invention is used with a car audio system, an audio signal corresponding to a received telephone call can be routed to the side of the car where the intended recipient of the call is seated. It can be configured whether the phone conversation in the car is primarily done by the driver or by the passenger of a car. In an embodiment, a default setting of the switch 333 may be configured based on whether the car has the driver seat on the left side or on the right side, so that without user intervention the audio of the first mono audio signal is always played on the driver's side of the car.

Furthermore, while the first mono audio signal is active, switch 333 may be controlled by user input on the keyboard 104 of apparatus 100. The user may select—among the options of the apparatus—that the phone audio is played on the left channel, on the right channel, or on both channels, in other words replacing the audio from the audio player 311. Apparatus 100 may store default settings to a memory.

In an embodiment, the other application 321 is a calendar application which generates an audio alert tone that is routed to switch 327. When the calendar application activates the audio alert, it also informs control block 313 of the active alert and requests an audio connection through communication bus 325. Responsive to the request, control block 313 sets switch 327 through control bus 323 in a position to route the audio signal from the calendar application to the first mono audio signal line 305.

In a further example embodiment, the other application 321 is a navigation application which routes audio announcements and signals to switch 327. Routing is controlled by control block 313 through control bus 323 as described above.

Control block 313 may also control the priorities of the applications. Switch 327 may be switched into a position where an audio output of the application block with the highest priority that is currently active is routed as the first mono audio signal line 305 to FM transmitter 301.

For example, a navigation application may have a higher priority than a messaging application. In a situation where the audio outputs of both applications may be simultaneously active, control block 313 controls switch 327 so that only the audio output with the higher priority is routed to the first mono audio signal line 305.

The control block may further control the application or the applications not having the higher priority to delay the audio output until no other application with a higher priority is active. In the situation where a higher priority application interrupts the audio output of a lower priority application, the control unit 313 may instruct the lower priority application via communication bus 325 to restart the audio playback, if possible. Communication between control block 313 and audio generating blocks 311, 317, 319 and 321 is provided by communication bus 325.

In an example scenario, the messaging application 319 may be producing an audio output to read out a received message. During this process, the navigation application with a higher priority requests an audio connection from control unit 313 through communication bus 325 in order to route audio output with a navigation instruction to the FM transmitter 301. Due to the higher priority, control unit 313 controls switch 327 to connect the audio output from the navigation application to the first mono audio signal line 305. The audio output from the messaging application is interrupted. The control unit 313 indicates through communication bus 325 to the messaging application 319 that the audio output was not routed to the FM transmitter completely. When the navigation application has stopped putting out audio, the control unit 313 instructs the messaging application 319 to restart playback of the received message. The control block 313 allows or denies routing of an audio output to the first mono audio signal and schedules requests for an audio connection.

Transmitter 301 transmits the input signals L1 and R1 as an RF signal through antenna 339.

The blocks in FIG. 3 may be implemented in hardware, software, or a combination of both. For example, the control block 313, switches 315*a* and 315*b* and the messaging application 319 may be implemented in software, for example as software instructions executed by a microprocessor or a digital signal processor. FM transmitter 301 may be implemented in hardware, and audio player 311 may comprise hardware and software blocks.

Figure 4:
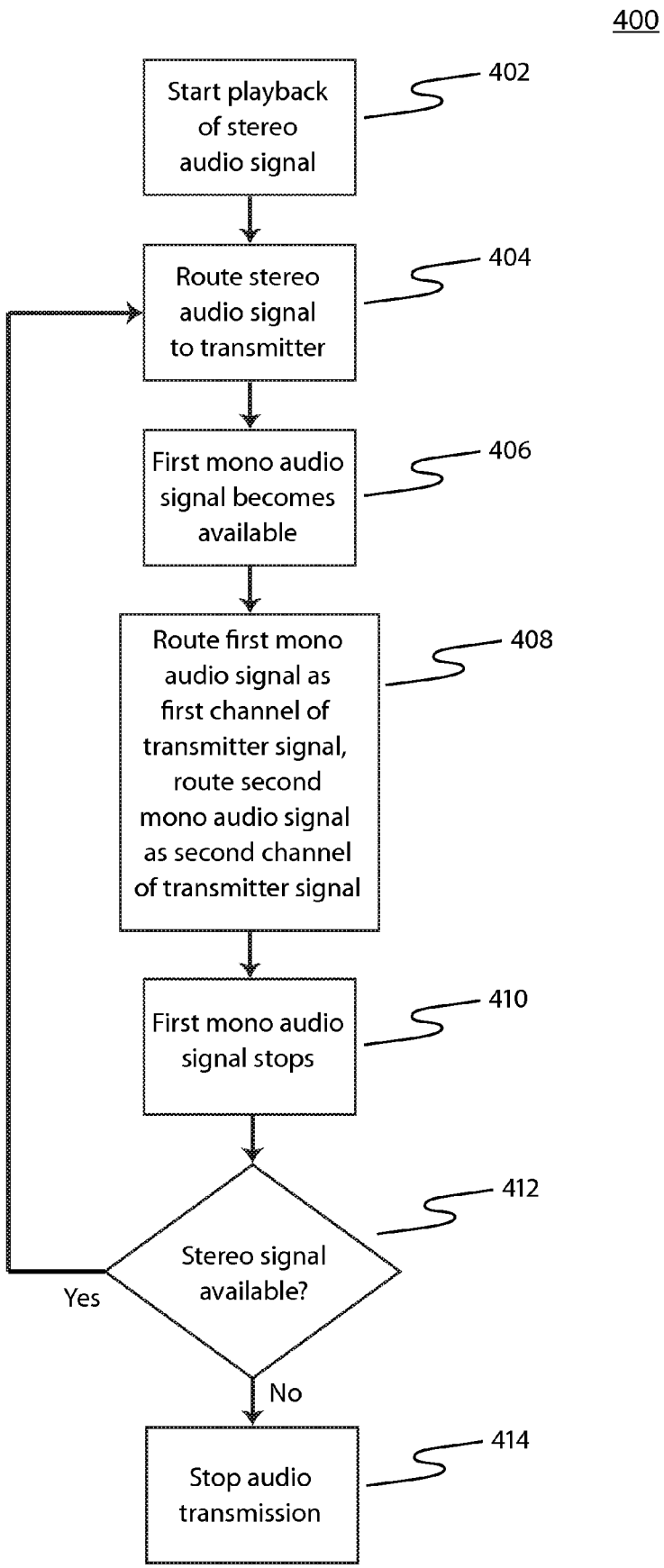
FIG. 4 shows a flow diagram of a method according to an embodiment of the invention.

FIG. 4 shows a flow chart for a method 400 that may be used in the apparatus 100. The method is explained in relation to FIG. 3. In step 402 playback of a stereo audio signal is started, for example by a user switching on the audio player or starting the audio player application 311. In step 404, the stereo audio signal is routed from the audio player 311 to the left and right inputs L1 and R1 of the transmitter 301. In step 406, a first mono audio signal becomes available, for example an audio signal from telephone application 317. In step 408, the first mono audio signal is routed on the first mono audio signal line 305 as a first channel of the transmitter signal, and a second mono audio signal is routed on the second mono audio signal line 307 as a second channel of the transmitter signal, controlled by control block 313 and switches 315*a* and 315*b*. In step 410, the first mono audio signal stops, for example because a phone call ends. In step 412 it is checked whether the stereo signal is still available, for example whether audio player 311 is still producing an audio output. If this is not the case, audio transmission is stopped in step 414. If, however, the stereo audio signal is still available, process 400 returns to step 404, so that the stereo audio signal is routed to the transmitter again.

Figure 5:
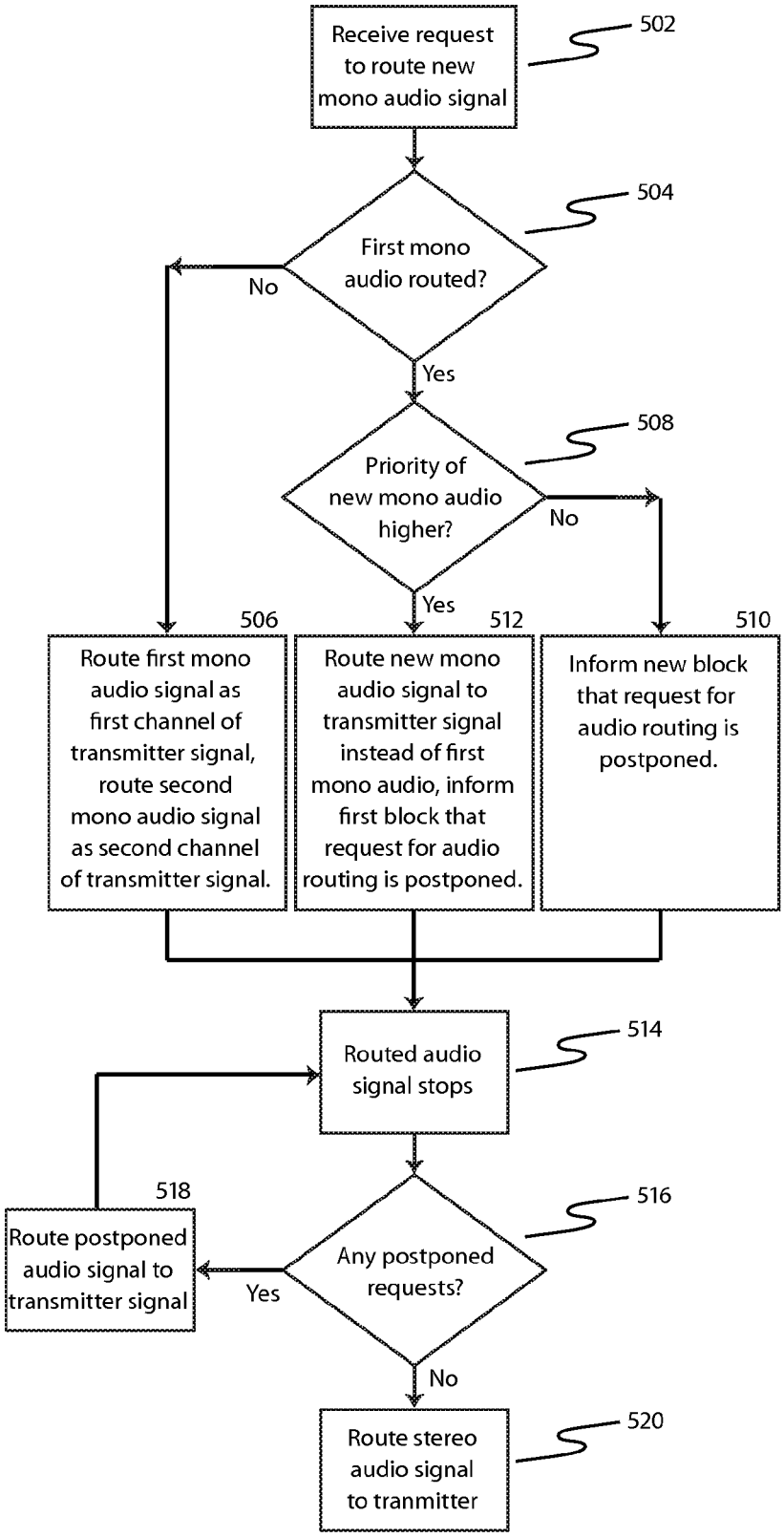
FIG. 5 shows a flow diagram of a method according to another embodiment of the invention.

FIG. 5 shows a flow chart for a method 500 that may be used when multiple applications generate an audio output at specific times. The process may start at any time,for example either when a stereo audio signal 303 is routed to transmitter 301 or when a first audio output by one block has already put the stereo audio signal on hold and is routed to transmitter 301 on the first mono audio signal line 305. For example, the messaging application 319 may be producing an audio output to read out a received message. In step 502 control block 313 receives a request to route a new mono audio signal, for example from a phone application 317. In step 504 control block 313 checks whether a first mono audio signal is already routed on the first mono audio signal line 305 to the transmitter 301, for example from messaging application 319 or from another application 321. If no first mono audio signal is already routed, then the process continues to step 506, and control block 313 controls switches 315*b* and 327 so that the new mono audio signal is routed as a first channel of the transmitter signal, for example as signal R1 of transmitter 301. Further, control block 313 controls switch 315*a* so that a second mono audio signal is routed as a second channel of the transmitter signal, for example a mono audio signal generated from the stereo audio signal from audio player 311, selected by switch 329 and routed as signal L1 of transmitter 301. If, however, in step 504 a first mono audio signal is already routed, for example from the messaging application 319, then in step 508 the priority of the new mono audio signal is compared to the priority of the first mono audio signal which is already routed to the transmitter. If the priority of the new mono audio signal is not higher than the priority of the other mono audio signal, then the block generating the new mono audio signal is informed in step 510 that the request for audio routing is postponed. If the priority of the new mono audio signal is higher than the priority of the other mono audio signal, then in step 512 the new mono audio signal is routed on the first mono audio signal line 305 to the transmitter instead of the first mono audio signal by adjusting switch 327 accordingly. Further, the block generating the first mono audio signal is informed that its request for audio routing is postponed through communication bus 325.

One mono audio signal is routed to transmitter 301 after steps 506, 510 or 512, while another mono audio signal (either the first or the new mono audio signal) is put on hold, in other words audio routing is postponed for the other mono audio signal after step 510 or 512.

At some time, the routed audio signal stops in step 514, for example because the phone call of telephone application 517 ends. It is then checked in step 516, whether any request for routing of another mono audio signal was postponed. The request may be postponed as a result from step 510, where a request was not handled as a higher priority audio signal was routed at that time. The request may also be postponed as a result from step 512, where a first mono audio signal was routed to the transmitter 301, but it was stopped before completion because of a new request with a higher priority. If a postponed request is still pending, the audio from the block corresponding to the pending request is routed to the transmitter 301 in step 518 by controlling switches 315*b* and 327 through control bus 323. The corresponding block is informed via communication bus 325 that it can restart or continue playback of the mono audio signal. If no postponed requests are pending any more, control block 313 controls switches 315*a* and 315*b* by control bus 323 in such a way that the stereo audio signal 303 from audio player 311 is routed to the transmitter in step 520.

While embodiments of the invention have mainly been described in the combination of a mobile device such as a mobile telephone comprising an FM transmitter, it is not limited to this particular combination. For a person skilled in the art many other useful combinations should be apparent. Just as an example a mobile computer may not have a telephone application, but a music player and a navigator application that generate an audio signal. Instead of an FM transmitter, a Bluetooth connection may be used and audio may be transmitted by use of the A2DP (advanced audio distribution profile) that supports stereo audio. In the same manner as described above, the L- and R-channel of the Bluetooth transmitter may receive either a stereo audio signal or a first and a second mono audio signal. A device with a Bluetooth receiver supporting A2DP will then play back either the stereo audio signal or the first and second mono audio signals without any further control. Further air interfaces and/or protocols may be used for multichannel transmission, for example for Dolby™ surround sound.

Without in any way limiting the scope, interpretation, or application of the claims appearing below, it is possible that a technical effect of one or more of the example embodiments disclosed herein may be that a user may start to listen to a phone conversation or to an audible notification without interrupting other persons in listening to an audio file or an audio stream.

Embodiments of the present invention may be implemented in software, hardware, application logic or a combination of software, hardware and application logic. The software, application logic and/or hardware may reside on a mobile device, a mobile computing device, a mobile phone, or a mobile audio or multimedia player. The application logic, software or an instruction set is preferably maintained on any one of various conventional computer-readable media. In the context of this document, a "computer-readable medium" may be any media or means that can contain, store, communicate, propagate or transport the instructions for use by or in connection with an instruction execution system, apparatus, or device.

If desired, the different functions discussed herein may be performed in any order and/or concurrently with each other. Furthermore, if desired, one or more of the above-described functions may be optional or may be combined.

Although various aspects of the invention are set out in the independent claims, other aspects of the invention comprise any combination of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

What is claimed is:

1. An apparatus comprising:

a multichannel audio transmitter, the multichannel audio transmitter having a first mode for transmitting a multichannel audio signal and a second mode for transmitting at least a first audio signal and a second audio signal, each of the first audio signal and the second audio signal having fewer channels than the multichannel audio signal; and a controller configured to switch the multichannel audio transmitter from the first mode to the second mode when the first audio signal becomes available.

2. An apparatus according to claim 1, wherein the first audio signal is transmitted on a first subset of channels from the multichannel audio transmitter and the second audio signal is transmitted on a second subset of channels from the multichannel audio transmitter.

3. An apparatus according to claim 1, wherein the multichannel audio signal is a surround sound signal.

4. An apparatus according to claim 1, wherein the multichannel audio transmitter is a stereo audio transmitter, the multichannel audio signal is a stereo audio signal, the first audio signal is a first mono audio signal and the second audio signal is a second mono audio signal.

5. An apparatus according to claim 4, wherein the second mono audio signal corresponds to the stereo audio signal.

6. An apparatus according to claim 5, wherein the second mono audio signal is either a right or a left channel of the stereo audio signal.

7. An apparatus according to claim 5, wherein the second mono audio signal is mixed from a right and a left channel of the stereo audio signal.

8. An apparatus according to claim 1, wherein the second audio signal is transmitted at a lower volume than the first audio signal.

9. An apparatus according to claim 1, wherein the second audio signal is transmitted at a lower volume than a channel of the multichannel audio signal.

10. An apparatus according to claim 1, the apparatus further comprising an audio player, wherein the multichannel audio signal is generated by the audio player.

11. An apparatus according to claim 1, the apparatus further comprising a mobile phone transceiver wherein the first audio signal is generated by the mobile phone transceiver.

12. An apparatus according to claim 11, wherein the first audio signal is a signaling tone of an incoming call.

13. An apparatus according to claim 11, wherein the first audio signal is a text to voice notification of an incoming message.

14. An apparatus according to claim 1, wherein the volume of at least one of the first audio signal and the second audio signal is adapted according to predetermined settings.

15. An apparatus according to claim 1, wherein the multichannel audio transmitter is a broadcast transmitter.

16. An apparatus according to claim 15, wherein the multichannel audio transmitter is a frequency modulation radio transmitter.

17. A method comprising:

transmitting with a multichannel audio transmitter a multichannel audio signal;

making a first audio signal available, wherein the first audio signal has fewer channels than the multichannel audio signal; and upon availability of the first audio signal, transmitting the first audio signal and a second audio signal instead of the multichannel audio signal, the second audio signal having fewer channels than the multichannel audio signal.

18. A method according to claim 17, wherein the first audio signal is transmitted on a first subset of channels from the multichannel audio transmitter and the second audio signal is transmitted on a second subset of channels from the multichannel audio transmitter.

19. The method according to claim 17, wherein the multichannel audio signal is a surround sound signal.

20. The method according to claim 17, wherein the multichannel audio transmitter is a stereo audio transmitter, the multichannel audio signal is a stereo audio signal, the first audio signal is a first mono audio signal and the second audio signal is a second mono audio signal.

21. The method according to claim 20, wherein the second mono audio signal corresponds to the stereo audio signal.

22. The method according to claim 21, wherein the second mono audio signal is either a right or a left channel of the stereo audio signal.

23. The method according to claim 21, wherein the second mono audio signal is mixed from a right and a left channel of the stereo audio signal.

24. The method according to claim 17, wherein the second audio signal is transmitted at a lower volume than the first audio signal.

25. The method according to claim 17, wherein the second audio signal is transmitted at a lower volume than a channel of the multichannel audio signal.

26. The method according to claim 17, wherein the multichannel audio signal is generated by an audio player.

27. The method according to claim 17, wherein the first audio signal is generated by a mobile phone transceiver.

28. The method according to claim 27, wherein the first audio signal is a signaling tone of an incoming call.

29. The method according to claim 27, wherein the first audio signal is a text to voice notification of an incoming message.

30. The method according to claim 17, wherein the volume of at least one of the first audio signal and the second audio signal is adapted according to predetermined settings.

31. The method according to claim 17, wherein the multichannel audio transmitter is a broadcast transmitter.

32. The method according to claim 31, wherein the multichannel audio transmitter is a frequency modulation transmitter.

33. A computer program product comprising a non-transitory computer-readable medium bearing computer program code embodied therein for use with a computer, the computer program code comprising:

code for transmitting by a multichannel audio transmitter a multichannel audio signal, code for making a first audio signal available, wherein the first audio signal has fewer channels than the multichannel audio signal; and code for upon availability of the first audio signal transmitting the first audio signal and a second audio signal instead of the stereo audio signal, wherein the second audio signal has fewer channels than the multichannel audio signal.

34. A non-transitory computer-readable medium encoded with instructions that, when executed by a computer, perform:

transmitting by a multichannel audio transmitter a multichannel audio signal;

making a first audio signal available, wherein the first audio signal has fewer channels than the multichannel audio signal; and upon availability of the first audio signal, transmitting the first audio signal and a second audio signal instead of the multichannel audio signal, wherein the second audio signal has fewer channels than the multichannel audio signal.

35. An apparatus comprising:

means for transmitting a multichannel audio signal;

switching means having a first mode for connecting a multichannel audio signal to a multichannel input of said means for transmitting and a second mode for connecting a first audio signal and a second audio signal to the multichannel input of said means for transmitting, wherein the first audio signal and the second audio signal each have fewer channels than the multichannel audio signal; and a controlling means configured to switch the switching means from the first mode to the second mode when the first audio signal is available.

* * * * *